US007066367B2

(12) United States Patent
Chandaria et al.

(10) Patent No.: US 7,066,367 B2
(45) Date of Patent: Jun. 27, 2006

(54) CONVERTIBLE CUTTER FOR TAPE DISPENSERS

(75) Inventors: Ashok Chandaria, Nairobi (KE); Kumud Shah, Willowdale (CA)

(73) Assignee: Conros Corporation, Ontario (CA)

( * ) Notice: Subject to any disclaimer, the term of this patent is extended or adjusted under 35 U.S.C. 154(b) by 165 days.

(21) Appl. No.: 10/259,620

(22) Filed: Sep. 30, 2002

(65) Prior Publication Data

US 2004/0060956 A1 Apr. 1, 2004

(51) Int. Cl.
*B26F 3/02* (2006.01)
*B65H 35/07* (2006.01)

(52) U.S. Cl. ..... 225/25; 225/47; 225/77; 225/91

(58) Field of Classification Search ..... 225/19, 225/20, 25, 26, 29, 30, 33, 46, 47, 49, 77, 225/80, 90, 91, 92; 118/43; 156/527
See application file for complete search history.

(56) References Cited

U.S. PATENT DOCUMENTS 3,348,524 A * 10/1967 Butler ..... 225/91 X
3,810,567 A * 5/1974 Malcolm ..... 225/91 X
RE30,787 E * 11/1981 Pool et al. ..... 156/527
4,437,854 A * 3/1984 Knoop ..... 225/25 X
4,540,393 A * 9/1985 Knoop ..... 225/25 X
4,989,769 A * 2/1991 Longworth et al. ..... 225/77 X
5,024,362 A * 6/1991 Karlsson ..... 225/20
5,186,376 A * 2/1993 Scharf et al. ..... 225/91 X

FOREIGN PATENT DOCUMENTS

WO WO 02/051734 A2 7/2002

* cited by examiner

*Primary Examiner*—Clark F. Dexter
(74) *Attorney, Agent, or Firm*—Sand & Sebolt

(57) ABSTRACT

A tape dispenser has first and second half-shells, with a dispensing end and a cutter end, and a first cutter member formed in and integral with the first half-shell, and having a plurality of upwardly directed serrations which define serrated cutting teeth at the top ends. First and second cutter retainer walls are provided; and a removable second cutter member is adapted to overlie the serrated cutting teeth of the first cutter member, and having a plurality of serrated cutting teeth of the same size and depth as those of said first cutter member.

4 Claims, 3 Drawing Sheets

CONVERTIBLE CUTTER FOR TAPE DISPENSERS

This invention relates to tape dispensers, and particularly to tape dispensers that may be provided with an integral, moulded cutter member, or with an additional metallic cutter, depending on the nature of the tape to be dispensed and cut.

FIELD OF THE INVENTION

Tape dispensers are well known. Typically, a tape dispenser, at least one which is provided for casual use or office use other than in a heavy metal desktop dispenser, is formed of moulded plastic, and comprises two mating halves with an integrally formed hub in the rear or storage end of the dispenser, where a roll of tape is stored and from which the tape is dispensed.

One of the inventors herein has provided significant improvements to tape dispensers, particularly by the provision of tape dispensers that have a built-in brake mechanism. Such structures have various embodiments, which comprise in one way or another a flexible side which in one way or another permits interference with the hub of the tape roll so as to brake its rolling movement. This, in turn, facilitates easier cutting of the tape at the cutter end of the tape dispenser, since the tape has no tendency to continue to unreel in an unwanted or uncontrolled fashion.

The details, however, of the prior tape dispensers having brake mechanisms are not repeated herein, as they are irrelevant to the present invention. They are, however, taught in detail in U.S. patent application Ser. No. 09/741,854 filed Dec. 22, 2000, now U.S. Pat. No. 6,612,474, and in U.S. application Ser. No. 09/883,306 filed Jun. 19, 2001, now abandoned. Both applications are filed in the name of Kumud Shah, one of the inventors herein.

The present invention is directed to tape dispensers that may be used with various kinds of tape to be dispensed. Presently, there are generally two kinds of tape dispensers, those with integrally moulded plastic cutters, and those with additionally added metal cutters. However, the two different kinds of tape dispensers are quite different one from the other in most respects; they require different tooling and different manufacturing procedures to make and assemble them, and care must be taken that if the dispenser is re-loaded with a further roll of tape, that the roll of tape which is used is suitable for the cutter assembly of the tape dispenser into which the new roll has been placed.

Particularly, tapes that are tougher, thicker, more cut-resistant, double-sided adhesive, or heavy duty, typically require the use of a metal cutter. Other, lightweight tapes such as semi-transparent tapes, and the like, may be quite easily cut using the moulded, integral plastic cutter.

Of course, all cutters, whether integrally moulded or additionally added, provide a set of serrated teeth which are oriented in such a manner as to be substantially perpendicular to the plane of the tape as it passes over the cutter and is applied against the cutter teeth for purposes of cutting the tape. Such action is, of course, well known, and need not be described herein.

However, tape dispensers that are provided with metal cutters are typically somewhat dangerous, and should, for example, not be used by small children. This is because the teeth of a metal cutter are exposed to an extent which might be one millimeter or more, they are hard, tough, and sharp, and can easily pierce the skin in such a manner that any lateral movement whatsoever may cause a severe cut in the skin.

One of the purposes of the present invention is to provide additional safety even though a metal cutter may be employed, because of the geometry of the metal cutter and the manner in which it is placed into the dispenser, as described hereafter.

To that extent, therefore, the present invention provides for an overlay metal cutter which may, or may not, be present.

That means that the same tooling for the plastic half-shells of tape dispensers, in keeping with the present invention, may be utilized whether or not an additional metal cutter is to be employed.

That, in turn, provides several options. The metal cutter is typically installed while the tape dispenser is being manufactured, depending on the type of tape which is to be placed into the tape dispenser for retail sale. It is kept in mind that, typically, any such dispensers as those described in the present invention are sold with a roll of tape in place within the dispenser.

However, instructions can be provided to the purchaser to permit the purchaser to withdraw the metal cutter from the structure of the dispenser, when the halves thereof have been disassembled, in the event that the dispenser is to be used by the purchaser for lightweight tapes.

Generally, however, that is not the case; the dispensers are provided, or are not provided, with the additional metal cutters, at the option of the manufacturer, depending on the type of tape to be dispensed therefrom. The dispensers are sold as single use, disposable dispensers.

BACKGROUND OF THE INVENTION

To that end, the present invention provides a tape dispenser for dispensing and cutting rolled tape from a hub on which the tape has been rolled, the hub being mounted in the tape dispenser. The tape dispenser comprises first and second half-shells which form first and second ends thereof. Hub-mounting means for the roll of tape are disposed within the tape dispenser.

The tape dispenser has a first, dispensing end and a second, cutter end, with the hub-mounting means being at the first end.

A first cutter member is formed and is integral with the first half-shell at the second end thereof.

The first cutter member has a plurality of upwardly directed serrations so as to define serrated cutting teeth at the top ends thereof.

There is a first slot and a retention land which are formed in the second end of the first half-shell behind the cutter member, with the retention land being spaced away from the cutter member by the first slot, and being closer to the first end of the dispenser than the first slot.

The retention land has a rear side which is remote from the first slot, and it is subtended by a downwardly and rearwardly directed stiffener wall located at the rear side of the retention land.

The first slot in the first cutter member extends from the end of the cutter member which is adjacent to the second end of the second half-shell when the two half-shells are assembled together to a distance such as to have a length which is less than the width of the cutter member as it extends across the second end of the first half-shell.

The first slot has a first edge which defines the front side of the retention land, and a second edge which is opposed to the first edge and which is situated behind the cutter member.

A first cutter retainer wall having a bottom edge, and extending downwardly and rearwardly from the second edge of the first slot, is formed integrally in the first half-shell.

So also is a second cutter retainer wall which extends forwardly from the stiffener wall in a position below the bottom edge of the first cutter retainer wall.

A removable second cutter member is provided and it is adapted to overlie the serrated cutting teeth of the first cutter member. The removable second cutter member has a plurality of serrated cutting teeth of the same size and depth as those of the first cutter member.

The removable second cutter has a first upwardly directed serrated wall which comprises the serrated cutting teeth thereof, a second rearwardly directed wall, a third downwardly directed wall, and a fourth rearwardly directed spring wall.

A second slot is formed in the region where the second rearwardly directed wall and the third downwardly directed wall of the second cutter member intersect. The second slot has a length such that the length of the remainder of the region where the second slot is formed, is not greater than the length of the first slot.

The fourth spring wall is curved upwardly so as to be lower at the outer ends thereof than in its middle region, so as to contact the bottom side of the second cutter retainer wall.

Typically, the retention land is upwardly curved.

The stiffener wall may have two portions, the first of which extends across the width of the first cutter member and depends downwardly from the rear side of the retention land. The second portion of the stiffener wall extends below the first portion and has a width less than that of the first portion.

Typically, the width of each of the first and second cutter retainer walls is substantially the same as the width of the first cutter member.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

Figure 1:
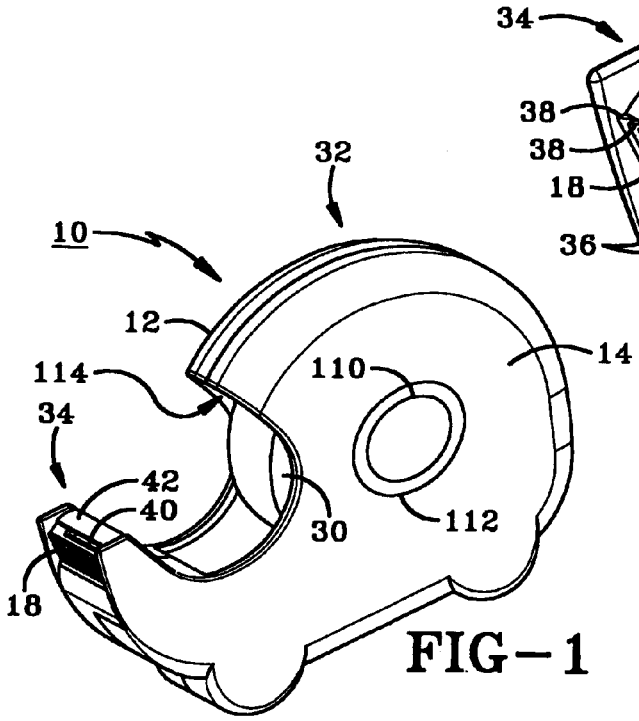
FIG. 1 is a perspective view of a first embodiment of the present invention, having a moulded integral first cutter member.

The novel features which are believed to be characteristic of the present invention, as to its structure, organization, use and method of operation, together with further objectives and advantages thereof, will be better understood from the following discussion.

Throughout the following discussion, the same reference numerals are employed for discussion of the various parts and integers of tape dispensers in keeping with the present invention. However, for purposes of clarity, not all not reference numerals will be found in each figure of drawing, even though the specific integer of the tape dispenser in keeping with the present invention may be illustrated in that figure of drawings.

Any tape dispenser 10 or 20 in keeping with the present invention, comprises to two half-shells 12 and 14. The two half-shells 12 and 14 are assembled together in the manner shown in FIGS. 1, 3, 7, and 9, and have a split or parting line 16 as shown particularly in FIGS. 2 and 4.

Every embodiment of the present invention incorporates a first cutter member 18; however, tape dispensers in keeping with the second embodiment of the present invention also incorporate a second cutter member 28.

Figure 8:
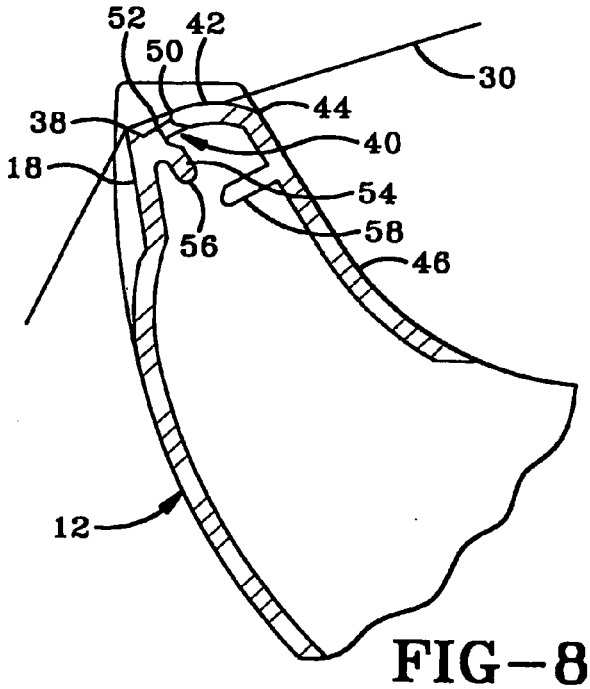
FIG. 8 is a cross section showing the locus of tape as it is being dispensed from the first embodiment of tape dispenser, as seen in the direction of arrows 8—8 in FIG. 7.
Figure 10:
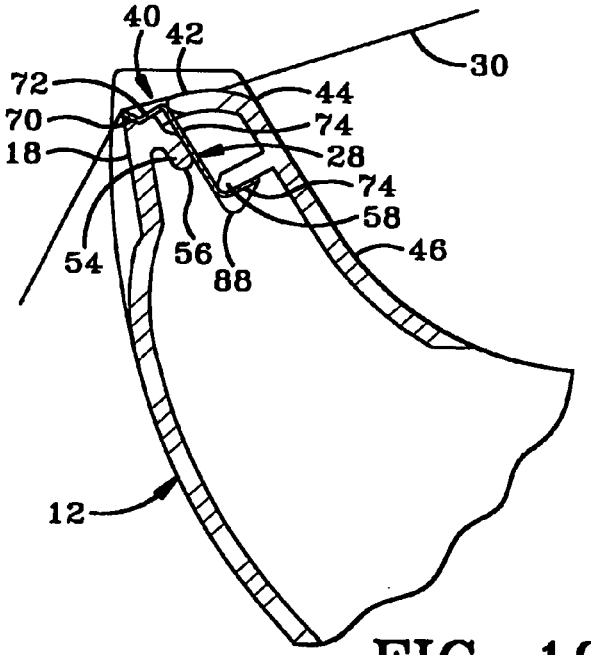
FIG. 10 is a view similar to FIG. 8, but of the second embodiment of the present invention, as seen in the direction of arrows 10—10 in FIG. 9.

A roll of tape 30 is installed in the tape dispenser, and it is unreeled in the manner shown in FIGS. 8 and 10. As is known in the prior art, the roll of tape 30 has a hub 110 mounted on a hub-mounting arrangement 112 (shown in dotted outline in FIG. 1) extending between the internal sidewalls of the two half-shells 12 and 14, which together form a cavity 114 in which the roll of tape is dispensed. It will be understood that the hub 110 and hub-mounting arrangement 112 would not normally be visible within the cavity 114.

Each tape dispenser has effectively two ends, a first dispensing end 32, and a second, cutter end 34. The second cutter end provides a cutting head for cutting of lengths of tape dispensed from the roll mounted on the hub-mounting arrangement 112. Obviously, the hub 110 and hub mounting arrangement 112 are found within the first end 32.

Figure 6:
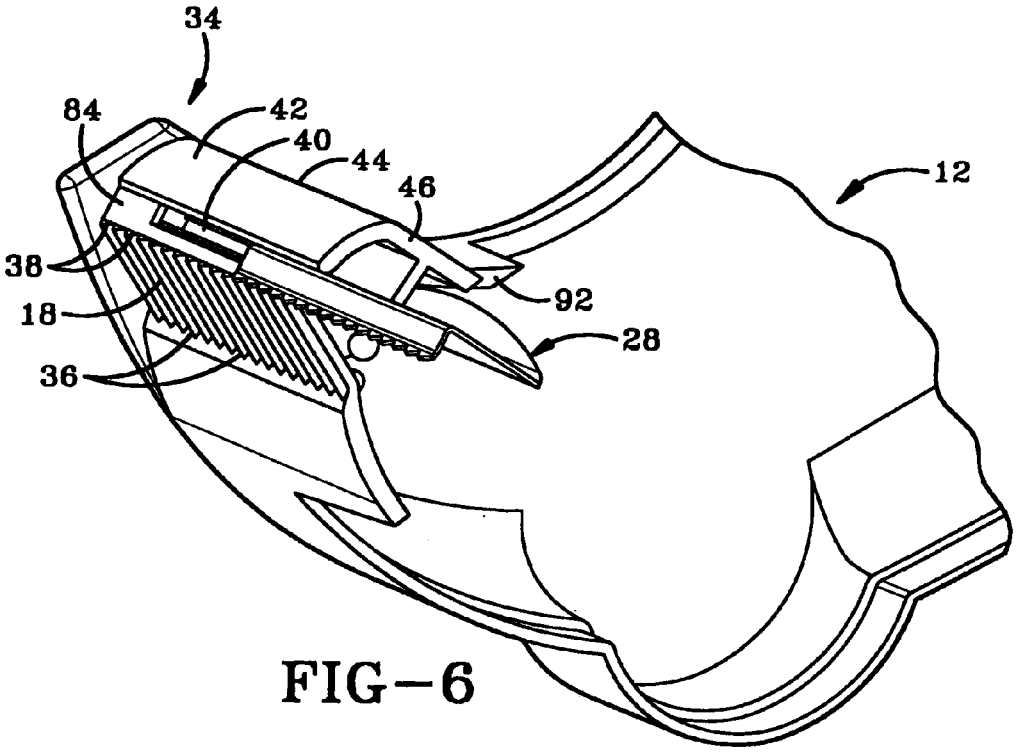
FIG. 6 shows installation of the metallic cutter member into a tape dispenser in keeping with the present invention.

The first cutter member 18 is clearly seen as being formed integrally with the first half-shell 12, as shown particularly in FIG. 6, at the second end 34 thereof.

The first cutter member has a plurality of upwardly directed serrations 36, which define serrated cutting teeth 38 at the top ends thereof. The cutting teeth 38 function in the well known manner, as can be particularly understood from FIG. 8.

There is a first slot 40 which is formed in the second end 34 of the first half-shell 12, in a position behind the cutter member 18. There is also a retention land 42 formed in the same region, as is illustrated throughout the figures of drawings.

It will be seen that the retention land 42 is spaced away from the first cutter member 18 by the first slot 40; and it will be seen that the retention land 42 is closer to the first end 32 of the tape dispensers in keeping with the present invention, than the first slot 40.

As seen particularly in FIGS. 8 and 10, as well as in FIG. 6, the retention land 42 has a rear side 44 which is remote from the first slot 40, and the rear side 44 is subtended by a downwardly and rearwardly directed stiffener wall 46 located thereat.

Figure 2:
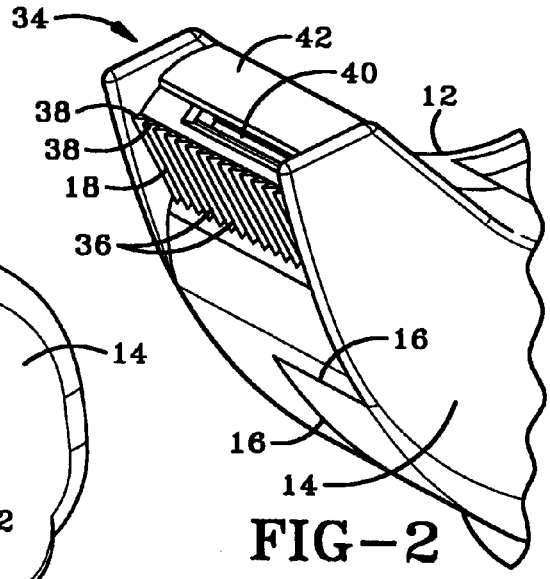
FIG. 2 is a view to a larger scale of the cutter member shown in FIG. 1.
Figure 3:
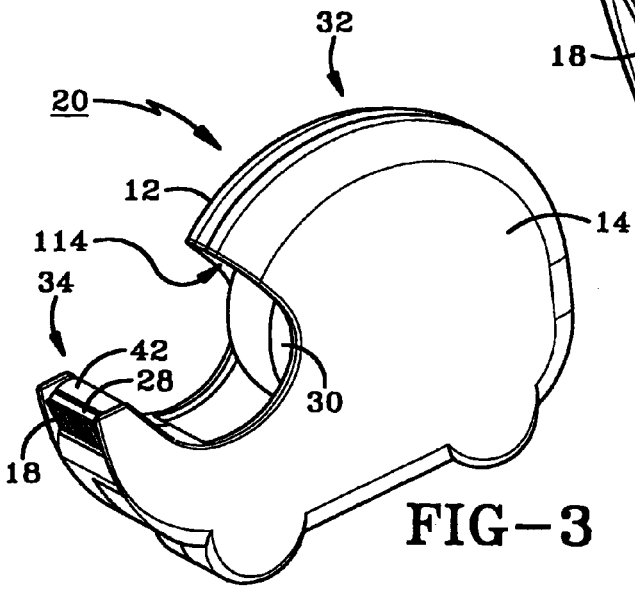
FIG. 3 is a view similar to FIG. 1, showing a second embodiment which incorporates an additional metallic cutter member element.
Figure 7:
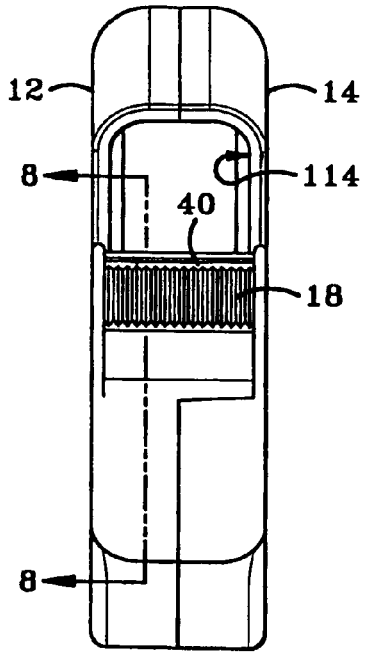
FIG. 7 is an end view of the first embodiment of tape dispenser in keeping with the present invention, from the cutter end thereof.

It will also be understood, particularly from FIGS. 2 and 6, that the first slot 40 extends from the end of the cutter member 18 which is adjacent to the second end 34 of the second half-shell 14, when the two half-shells are assembled together. The extent to which the first slot 40 extends is such that it has a length which is less than the width of the first cutter member 18 as it extends across the second end 34 of the first half-shell 12. This is also seen in FIG. 7.

As seen particularly in FIG. 8, the first slot 40 has a first edge 50 which defines a front side of the retention land 42, and the first slot 40 also has a second edge 52 which is opposed to the first edge 50, and is situated behind the cutter member 18.

Also as seen in FIG. 8, as well as FIG. 6, there is a first cutter retainer wall 54 which has a bottom edge 56, and it extends downwardly and rearwardly from the second edge 52 of the first slot 40.

There is also a second cutter retainer wall 58 which extends forwardly from the stiffener wall 46 in a position below the bottom edge 56 of the first cutter retainer wall 54.

Figure 5:
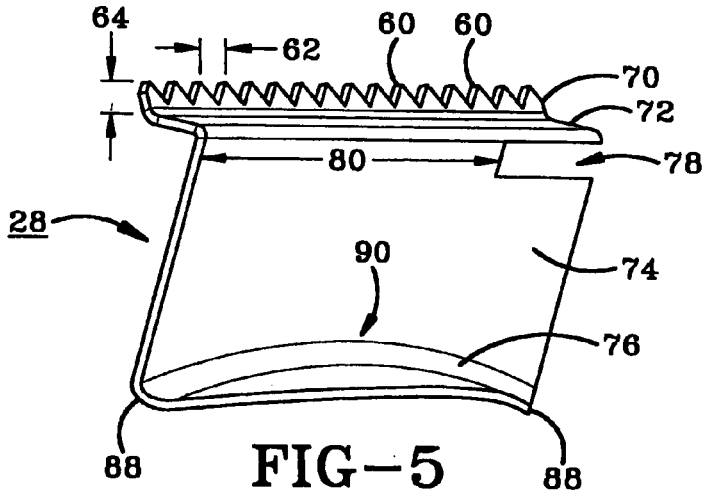
FIG. 5 is a perspective view of the additional metallic cutter member.

Turning to FIGS. 5 and 10, specific details of the second cutter member 28 are now described. It will be understood from the above discussion that the presence of the second cutter member 28 in a tape dispenser in keeping with the present invention, is elective and is contingent primarily upon the type of tape to be dispensed from the tape dispenser.

Figure 4:
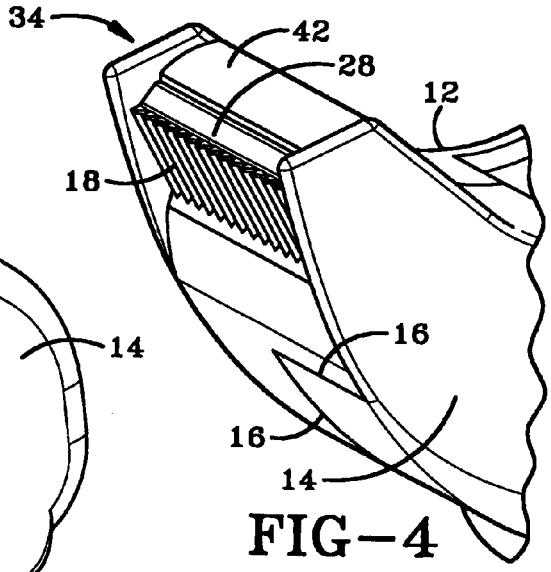
FIG. 4 is a view similar to FIG. 2, but of the second embodiment.
Figure 9:
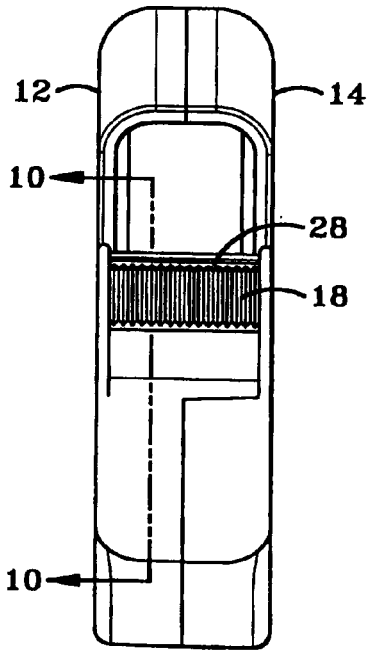
FIG. 9 is a view similar to FIG. 7, showing the second embodiment with the additional metal cutter member installed in the tape dispenser.

It will also be clearly understood from FIGS. 4 and 9, as well as FIG. 10, that the removable second cutter 28 is adapted to overlie the serrated cutting teeth 38 of the first cutter member 18. To that end, the removable or second cutter member 28 has a plurality of serrated cutting teeth 60 which have the same size and depth as the serrated cutting teeth 38 of the first cutter member 18. That is to say, the size or pitch 62 of the teeth 60 of the cutter member 28, and the depth of serrations 64, will be the same as those of the teeth 38. Therefore, the overlie of the cutter member 28 as seen particularly in FIG. 10, is such that the teeth 60 are not interfered with by the teeth 38.

On the other hand, it will be clearly understood that a considerable safety advantage is achieved because of the manner in which the teeth 60 overlie the teeth 38, and thus there is less risk to the hands of the user or, for example, of a child playing with the dispenser in an unsupervised manner.

The cutter member 28 has a first upwardly directed serrated wall 70 which comprises the serrated cutting teeth 60, a second rearwardly directed wall 72, a third downwardly directed wall 74, and a fourth rearwardly directed spring wall 76.

A second slot 78 is formed in the second cutter member 28, in the region where in the second rearwardly directed wall 72 and the third downwardly directed wall 74 intersect. The second slot 78 has a length which is such that the length of the remainder of that region, as shown at 80, is not greater than the length of the first slot 40. Thus, when the second cutter member 28 is assembled to the first half-shell 12, the second slot 78 will be accommodated by the region 84 shown in FIG. 6 at the end of the first slot 40.

As seen in FIG. 5, the fourth spring wall 76 is curved upwardly so as to be lower at its outer ends 88 than in the middle region 90, so that when the second cutter member 28 is assembled to the first half-shell 12, in the manner shown in FIG. 6, the spring wall 76 will contact the bottom side of the second cutter retainer wall 58.

Accordingly, it can be understood from the above, and from an inspection of FIGS. 6 and 10, in particular, that assembly of the second cutter member 28 to the first half-shell 12 of a tape dispenser in keeping with the present invention, will provide a second embodiment 20 as opposed otherwise to the first embodiment 10, which does not comprise the second cutter member.

Of course, as noted above, typically such assembly is made by the manufacturer of the tape and the tape dispenser so that they are sold as a unit, for single use, after which the tape dispenser is disposed of. However, electively, the manufacturer might choose to teach the retail customer how to disassemble and remove the second cutter member 28, in the event of further use of the tape dispenser for tape types other than those for which the tape dispenser was originally sold. Such a step is generally not likely, but might be taken in the interest of ecology and the environment, in respect of recycling the dispenser for further use.

Typically, and particularly as seen in FIGS. 8 and 10, the retention land 42 is upwardly curved.

Moreover, the stiffener wall 46 may have two portions, the second of which is shown at 92 in FIG. 6. Thus, the first portion of the stiffener wall 46 extends across the width of the first cutter member 18 and depends downwardly from the rear side 44 of the retention land 42; while the second portion 92 of the stiffener wall 46 extends below the first portion and has a width less than that of the first portion thereof.

It will be understood from the figures of drawings that, typically, the width of the first and second cutter retainer walls 54 and 58 is each substantially the same as the width of the first cutter member 18.

It will be clear from the above discussion that specific details of the design of the half-shells, particularly at the cutter end thereof, and of the design of the elective second cutter member 28, may be altered, without departing from the spirit and scope of the appended claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

What is claimed:

1. A tape dispenser for dispensing and cutting rolled tape from a hub, said tape dispenser comprising:

first and second half-shells having sidewalls assembled to form a cavity for receiving said rolled tape mounted therein on hub-mounting means disposed within said cavity and a cutting head to permit lengths of dispensed tape to be cut off;

said tape dispenser having a first end and a second end, with said hub-mounting means being at said first end and said cutting head being at said second end;

a first cutter member located in said cutting head and integral with said first half-shell, said first cutter member having a plurality of upwardly directed serrations defining serrated cutting teeth at top ends thereof and having a width dimension extending across said cutting head;

a first slot and a retention land formed in cutting head behind said first cutter member, said retention land being spaced away from said first cutter member by said slot, and being closer to said first end of said tape dispenser than said first slot;

said retention land having a rear side remote from said first slot and being subtended by a downwardly and rearwardly directed stiffener wall located at said rear side;

said first slot extending across said cutting head from the sidewall of said second half shell to a point spaced from the sidewall of said first half shell so as to span a distance that is less than the width dimension of said first cutter member;

said first slot having a first edge defining a front side of said retention land, and a second edge opposed to said first edge, said first slot being situated behind said first cutter member;

a first cutter retainer wall having a bottom edge, and extending downwardly and rearwardly from said second edge of said first slot;

a second cutter retainer wall extending forwardly from said stiffener wall in a position below the bottom edge of said first cutter retainer wall, said second cutter retainer wall having a bottom edge; and a removable second cutter member overlying the serrated cutting teeth of said first cutter member, and having a plurality of serrated cutting teeth of the same size and depth as those of said first cutter member;

said removable second cutter member having a first upwardly directed serrated wall which comprises said serrated cutting teeth, a second rearwardly directed wall, a third downwardly directed wall, and a fourth rearwardly directed spring wall;

wherein a second slot is formed in a region where said second rearwardly directed wall and said third downwardly directed wall of said second cutter member intersect, said second slot having a length such that the length of the remainder of said region is not greater than the length of said first slot; and wherein said fourth spring wall is curved upwardly so as to be lower at the outer ends thereof than in its middle region, so as to contact the bottom edge of second cutter retainer wall.

2. The tape dispenser of claim 1, wherein said retention land is upwardly curved.

3. The tape dispenser of claim 1, wherein said stiffener wall has two portions, a first of which extends across the width dimension of said first cutter member and depends downwardly from said rear side of said retention land;

and a second of which extends below said first portion and has a width less than that of said first portion.

4. The tape dispenser of claim 1, wherein a width dimension of each of said first and second cutter retainer walls is substantially the same as the width dimension of said first cutter member.

* * * * *